United States Patent [19]

Conklin

[11] 3,999,698

[45] Dec. 28, 1976

[54] METHOD OF SEALING A PYROELECTRIC TARGET IN A VACUUM TIGHT ENVELOPE

[75] Inventor: Thomas H. Conklin, Ridgefield, Conn.

[73] Assignee: North American Philips Corporation, New York, N.Y.

[22] Filed: Aug. 29, 1975

[21] Appl. No.: 609,013

[52] U.S. Cl. ..... 228/122; 29/25.13; 316/17; 228/115

[51] Int. Cl.[2] ..... H01J 9/20

[58] Field of Search ..... 228/263, 121, 122, 115, 228/116; 29/25.13; 316/17, 19; 313/383, 390

[56] References Cited

UNITED STATES PATENTS

| | | | |
|---|---|---|---|
| 2,984,759 | 5/1961 | Vine | 313/390 |
| 3,826,943 | 7/1974 | Kawamura et al. | 313/383 |
| 3,873,872 | 3/1975 | Conklin et al. | 313/390 X |

*Primary Examiner*—Al Lawrence Smith
*Assistant Examiner*—K. J. Ramsey
*Attorney, Agent, or Firm*—Frank R. Trifari; Carl P. Steinhauser

[57] ABSTRACT

A pyroelectric target for a vidicon is effectively sealed in a vacuum-tight envelope by resiliently mounting in a retainer ring bonded by indium to a window transparent to visible and infra-red radiation. The window is then sealed in one end of an envelope which is evacuated.

3 Claims, 2 Drawing Figures

METHOD OF SEALING A PYROELECTRIC TARGET IN A VACUUM TIGHT ENVELOPE

The invention relates to a method of assembling a target for a pyroelectric vidicon which is sealed into one end of envelope and the latter evacuated.

The pyroelectric target, which may be tri-glycine sulfate, (TGS), tri-glycine fluoberyllate (TGFB), deuterated triglycine fluoroberyllate (DGTFB), alanine tri-glycine sulfate or any of numerous other materials which are known to be pyroelectric, because it responds to power, can be useful over a spectral range from visible to submillimeter radiation. A selection of proper window for each wave-length region and sometimes the difficulty of producing vacuum tight seals with these windows has led to the use of indium seals. This then produced the problem of mounting the pyroelectric target into the vidicon structure.

It is, accordingly, a principal object of the invention to provide a method of mounting a pyroelectric target using an indium seal for sealing the target in a vidicon structure.

Further objects of the invention will appear as the specification progresses.

In order to simplify the mounting of the target and sealing in the vidicon structure, in accordance with the invention, small spheres of indium are placed under a retainer ring and pressed using a flat fixture and sufficient pressure to cause the indium to flow so as to produce a bond between the retainer ring and the window. The pyroelectric target is then placed into the ring with a flat washer over it. A weak spring is placed over the washer and clamped by means of tabs welded on the retainer ring. The whole assembly is then ready to be indium sealed into one end of an envelope which is then evacuated.

The invention will be described further with reference to drawing in which.

Figure 1:
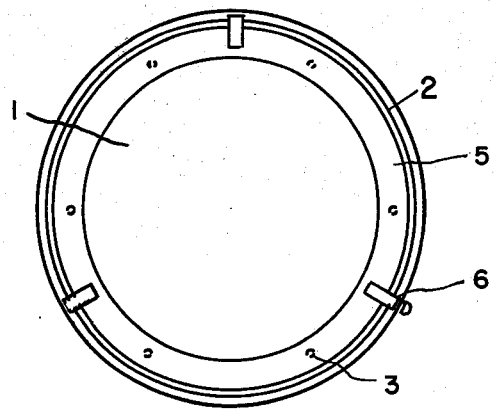
FIG. 1 is a plan view of the target assembly.
Figure 2:
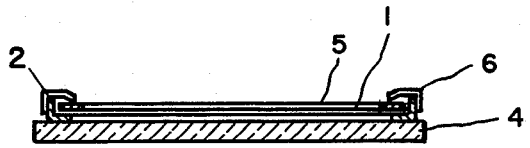
FIG. 2 is an elevational view

The pyroelectric target 1, a disc of tri-glycine sulfate, is supported within an annular retainer ring 2 by a number of pellets 3 of indium which have been pressed against window 4 transparent to visible and/or infra-red radiation. Pyroelectric target 1 is held in place by a flat washer and spring 5 and clamped by means of tabs 6.

Instead of indium (which is preferred) other soft metals, such as gallium, or an indium-gallium alloy may be used.

I claim:

1. A method of sealing a pyroelectric target in a hermetically sealed envelope comprising the steps of placing a plurality of soft metal bodies at spaced points on a window transparent to visible and infra-red radiation, placing an annular retainer member over the metal bodies, applying pressure sufficient to cause the metal to flow, placing the pyroelectric target within the annular retainer member, resiliently securing said pyroelectric target member within said retainer member, and thereafter sealing said window in one end of an envelope which is subsequently evacuated.

2. A method as claimed in claim 1 wherein the metal bodies are indium.

3. A method as claimed in claim 2 wherein the pyroelectric target is tri-glycine sulfate.

* * * * *